US005744920A

United States Patent [19]

Orton

[11] Patent Number: 5,744,920

[45] Date of Patent: Apr. 28, 1998

[54] SPEED CONTROLLER WITH IMPROVED BATTERY POWER TRANSFER

[76] Inventor: Kevin R. Orton, Tekin Electronics, Inc., 940 Calle Negocio, San Clemente, Calif. 92673

[21] Appl. No.: 797,984

[22] Filed: Feb. 12, 1997

[51] Int. Cl.[6] ..... H02P 1/00

[52] U.S. Cl. ..... 318/139; 388/804; 320/21

[58] Field of Search ..... 318/139, 138, 318/254, 432, 801, 802, 805, 806, 807–811; 388/804, 811, 829, 831; 320/21, 54; 363/123–125, 127, 128

[56] References Cited

U.S. PATENT DOCUMENTS

| | | | |
|---|---|---|---|
| 3,697,805 | 10/1972 | Switsen | 315/241 P |
| 3,840,796 | 10/1974 | Tozaki | 320/140 |
| 3,940,882 | 3/1976 | Mabuchi . | |
| 4,168,468 | 9/1979 | Mabuchi et al. | 340/825.63 |
| 4,309,645 | 1/1982 | Villeneuve | 388/829 |
| 4,584,504 | 4/1986 | Lee et al. | 318/16 |
| 5,216,337 | 6/1993 | Orton et al. | 318/16 |
| 5,563,479 | 10/1996 | Suzuki | 318/139 |
| 5,577,154 | 11/1996 | Orton | 388/811 |
| 5,619,076 | 4/1997 | Layden et al. . | |

OTHER PUBLICATIONS

Article in the Nov. 1996 issue of Xtreme magazine (a publication of Team Action Publishing, Rowland Heights, California) by Mike Velez (publisher/editor) entitled "Tekin's G–9 Supersonic Hype or Horsepower?" pp. 36–39.

*Primary Examiner*—Brian Sircus

*Attorney, Agent, or Firm*—Loyal McKinley Hanson

[57] ABSTRACT

A method for reducing the amount of power dissipated in the internal resistance of a battery supplying current to a load through a circuit that switches the battery on and off at a known switching rate and duty ratio to result in ON periods during which the battery is coupled to the load and OFF periods during which the battery is not coupled to the load, includes the step of providing a bank of capacitors connected across the battery. The bank of capacitors has at least one capacitor, a combined equivalent series resistance less than the internal resistance of the battery, and a combined capacitance such that the product of the combined capacitance expressed in microfarads and the switching rate expressed in Hertz is at least $4\times10^6$. The method proceeds by storing energy from the battery in the bank of capacitors during the OFF periods for contribution to the load during the ON periods. In line with the above method, a control system for a radio controlled (R/C) model includes a speed controller with the bank of capacitors having the attributes described above connected across the battery terminals.

7 Claims, 2 Drawing Sheets

SPEED CONTROLLER WITH IMPROVED BATTERY POWER TRANSFER

BACKGROUND OF THE INVENTION

1. Technical Field

This invention relates generally to a control system that switches battery current on and off at a controlled rate and duty ratio in controlling the amount of power supplied to a load, and more particularly to a method and control system for more efficient power transfer from a nickel cadmium battery to the drive motor of a radio controlled (R/C) model or other on/off load.

2. Description of Related Art

Battery power is the gasoline that an R/C model must use efficiently to remain competitive during a race. R/C manufacturers, operators, and other enthusiasts seek more efficient use of battery power in every possible way. They know that reducing the power dissipated in internal battery resistance can help them do so.

To focus on that aspect, recall that a typical R/C model control system includes a speed controller that controls the speed of a drive motor according to setpoint information transmitted to the R/C model by a handheld transmitter unit. The speed controller electronically switches battery current to the drive motor on and off at a fixed rate (e.g., 3,500 Hertz to 25 KHz) while varying the duty ratio (i.e., the ON time per cycle) according to the setpoint information. That turns out to be a convenient, effective, and commonly used way of controlling the average amount of current supplied to the motor per cycle and, thereby, the speed of the motor.

One problem, however, especially to a power-conscience R/C enthusiast, is that internal battery resistance dissipates some of the battery power as heat, or $I^2R_i$ loss. The exponential relationship of power loss to current can be troublesome. Even when the duty cycle is reduced (shorter ON time) from the maximum value to some mid value for partial throttle operation, maximum current still flows during the shorter ON time. As a result, the power loss in the internal battery resistance is still a function of the square of the maximum current.

From another point of view, the internal battery resistance effects battery output voltage. For example, a typical R/C nickel cadmium battery may include six 1.2-volt cells connected in series, with a resulting no-load effective battery output voltage of 7.2 volts and an effective combined internal battery resistance of about 0.050 ohms. As the battery delivers maximum current to the R/C drive motor during the ON time (e.g., 60 amperes), the voltage drop across the internal battery resistance is 3 volts. As a result, the effective battery output voltage drops to only 4.2 volts during the ON time, despite the speed.

From either viewpoint, system performance suffers. Thus, R/C manufacturers, operators, and other enthusiasts need a way to improve battery power transfer by reducing $I^2R_i$ loss and increasing effective battery output voltage.

SUMMARY OF THE INVENTION

This invention alleviates the problem outlined above by providing a circuit which capacitively loads the battery with a bank of one or more high grade capacitors having a known combined capacitance and a series equivalent resistance less than the combined internal resistance of the battery. The bank of capacitors charges while the speed controller is in the OFF state so that it is ready to contribute current when the speed controller is in the ON state. That serves to moderate current excursions in order to decrease $I^2R_i$ loss and increase effective battery output voltage while maintaining a desired average current. Stated another way, it results in an effective internal battery resistance that is less than the actual combined internal battery resistance.

To paraphrase some of the claim language, the invention provides a method for reducing the amount of power dissipated in the internal resistance of a nickel cadmium battery supplying current to a load (e.g., an R/C drive motor) through a circuit that switches the battery on and off at a known rate and duty ratio to result in ON periods during which the battery is coupled to the load and OFF periods during which the battery is not coupled to the load. The method includes the step of providing a bank of capacitors connected across the battery, the bank of capacitors having at least one capacitor, a known combined capacitance, and a combined equivalent series resistance. The combined equivalent series resistance of the bank of capacitors is less than the internal resistance of the battery (e.g., 0.0125 ohms). The combined capacitance is such that the product of the capacitance expressed in microfarads (e.g., 1200 microfarads) and the switching frequency expressed in Hertz (e.g., 3,334 Hz) is at least 4,000,000 (i.e., $4\times10^6$) for sufficient energy storage. The method proceeds by storing power from the battery in the bank of capacitors during the OFF periods for contribution to the load during the ON periods.

In line with the above method, a control system for an R/C model includes a speed controller having an input connected to a battery, an output connected to a motor, and means in the form of a circuit connected between the input and the output for switching current from the battery to the motor on and off at a known rate and duty ratio to result in ON periods during which the battery is coupled to the motor and OFF periods during which the battery is not coupled to the motor. A bank of capacitors having the characteristics described above is provided. It is connected across the battery so that it stores power from the battery capacitors during the OFF periods for contribution to the load during the ON periods.

Thus, the invention reduces $I^2R_i$ loss and increases effective battery output voltage while maintaining a desired average current. The following illustrative drawings and detailed description make the foregoing and other objects, features, and advantages of the invention more apparent.

DESCRIPTION OF THE PREFERRED EMBODIMENTS

Figure 1:
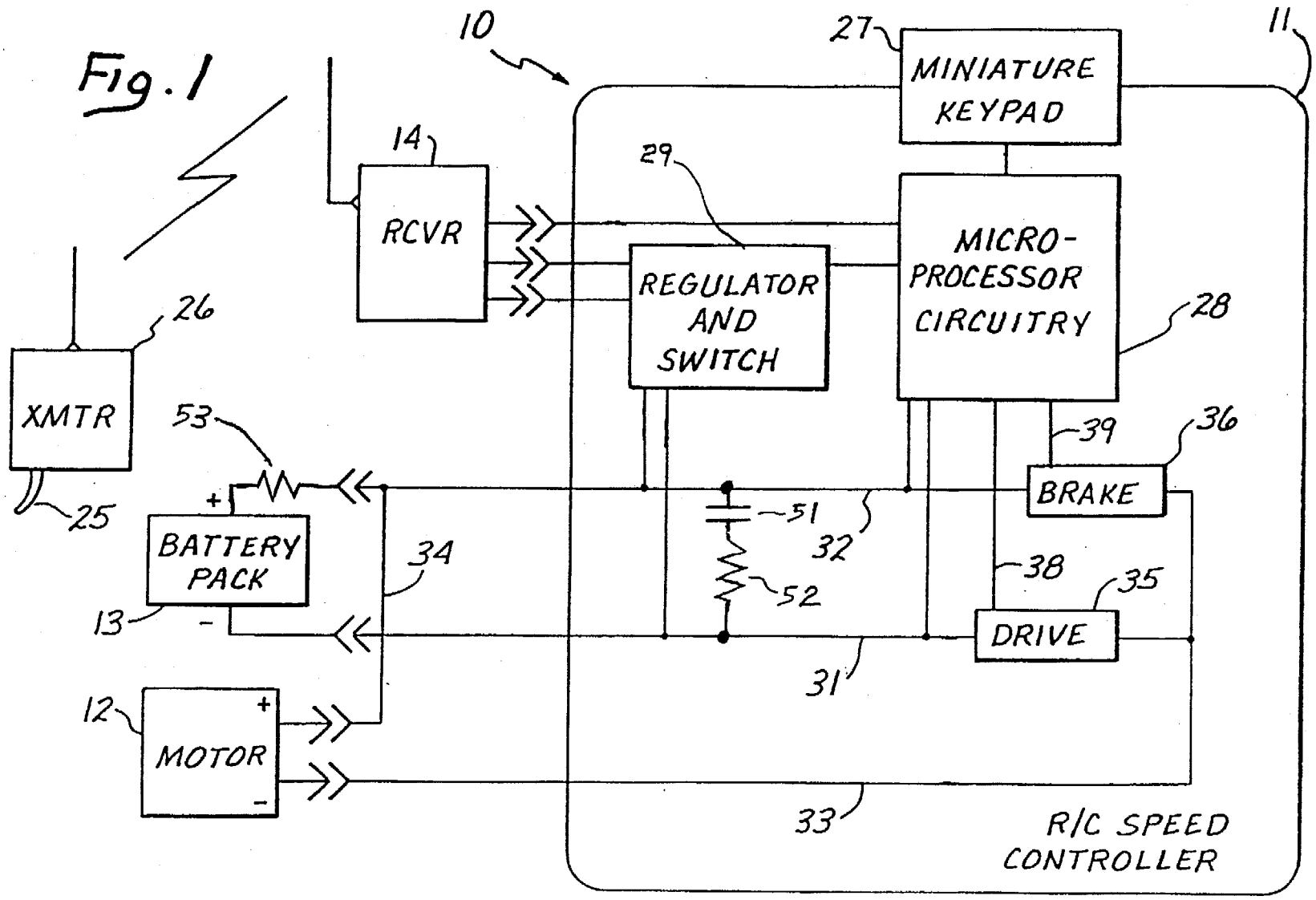
FIG. 1 of the drawings is a block circuit diagram of an R/C control system constructed according to the invention.

FIG. 1 of the drawings show one version of an R/C model speed controller 10 constructed according to the invention. It combines with an R/C model receiver, transmitter unit, battery, and motor as subsequently described to form an R/C model control system constructed according to the invention. The following description begins with an overview of the R/C model control system, and that is followed by further particulars of the invention.

OVERVIEW. The R/C model control system is similar in many respects to the systems described in U.S. Pat. Nos. 5,216,337 and 5,577,154, and those patents are incorporated herein by reference for the details provided. Generally, the speed controller 10 includes a module 11 (a housing) that houses and supports control circuitry. The module 11 is adapted to be mounted on a conventional R/C model (e.g., it may measure about 4.0 cm by 3.5 cm by 1.5 cm) and the control circuitry is miniaturized sufficiently to fit on/within the module 11. The module 11 may mount on the R/C model by known means (e.g., double-backed adhesive tape or screws) and it serves the function of housing and supporting the various electronic circuit components of the control circuitry.

Suitable wiring electrically connects the control circuitry to a drive motor 12, a nickel cadmium battery 13, and a receiver 14. Those components are mounted on an R/C model. An R/C model is not illustrated in the drawings, but it may take any of various known forms. The receiver 14 is adapted to be mounted on it, along with the speed controller 10 and the battery 13.

The speed controller 10 operates conventionally in some respects in the sense that it couples power from the battery 13 to the motor 12 according to speed and braking information received from the receiver 14. In other words, it changes the speed and braking of the motor 12 according to the speed and braking information. Manipulating a trigger 25 on a transmitter unit 26 results in the speed controller 10 controlling the motor 12 accordingly, after desired operating parameters are first entered via a miniature keypad 27 to microprocessor circuitry 28. A regulator and switch circuit 29 includes suitable components to provide regulated 5.5 volts to the receiver 14. It also includes suitable components, such as a semiconductor switch, for example, for turning off power to the receiver 14 under control of the microprocessor circuitry 28.

The control circuitry includes a drive circuit 35 and a brake circuit 36. The drive circuit 35 is connected between a first battery line 31 and a motor line 33. There, it controls the flow of current between the battery 13 and the motor 12 by providing a switchable low impedance path. It switches under control of the microprocessor circuitry 28 between an ON state in which it couples the first battery line 31 to the motor line 33 and an OFF state in which it decouples the first battery line 31 from the motor line 33.

The brake circuit 26 is connected between the motor line 33 and the second battery line 32. There, it facilitates deceleration of the motor 12 by providing a switchable low impedance path for flyback current. It switches under control of the microprocessor circuitry 28 between a first brake circuit state in which it couples the motor line 33 to the second battery line 32 and a second brake circuit state in which it decouples the second battery line 32 from the motor line 33.

The microprocessor circuitry 28 is coupled to the first and second battery lines 31 and 32 for power. It is coupled to the receiver for receiving the speed and braking information, and it is coupled to the keypad 27 in order to respond to keypad entries. A control line 38 couples a drive circuit control signal from the microprocessor circuitry 28 to the drive circuit 35, and a control line 39 couples a brake circuit control signal to the brake circuit 36.

Interconnected that way, the microprocessor circuitry 28 performs the function of switching the drive circuit 35 and the brake circuit 36 under program control according to speed and braking information received on the receiver line 30. To operate the motor, the microprocessor circuitry 28 cycles the drive circuit 35 between the ON state and the OFF state in a series of cycles at a predetermined rate (e.g., 16,600 Hz) and a variable drive circuit duty ratio so that the instantaneous drive circuit duty ratio corresponds to (follows) the speed information received from the receiver 14. The drive circuit 35 includes one or more semiconductor devices capable of switching the current supplied by the battery 13 to the motor 12. It switches the drive circuit 35 under program control to cause pulses of current of desired duration and repetition rate to flow to the motor 12. The microprocessor circuitry 28 varies the duration and repetition rate to achieve the desired current flow. In that way, it controls the flow of battery power to the motor 12 and thereby controls motor operation accordingly.

FURTHER PARTICULARS. Thus, the illustrated R/C model control system includes a speed controller 10 for changing the speed and braking of a drive motor of the model according to speed and braking information sent to the speed controller 10. It includes a receiver unit 14 operationally interconnected with the speed controller 10 for sending the speed and braking information to the speed controller 10 according to speed and braking information received by the receiver 14. And it includes a transmitter unit 26 for transmitting the speed and braking information to the receiver 14 according to speed and braking setpoint information inputted to the transmitter unit 14 by an operator with a moveable member on the transmitter unit (i.e., the throttle/brake trigger 25).

Figure 2:
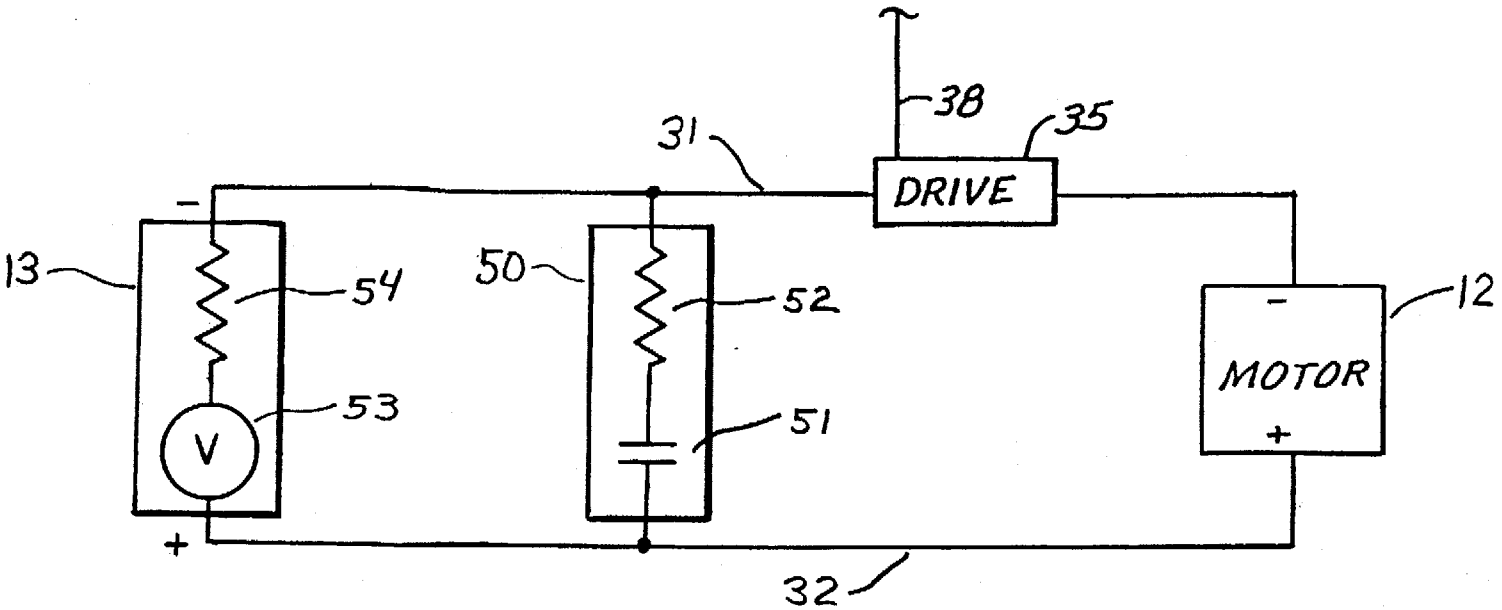
FIG. 2 is a simplified block diagram of the control system that focuses on the components of primary concern.

According to a major aspect of this invention, the R/C model control system includes a bank of capacitors 50 connected across the battery 13 as illustrated in the block diagram of FIG. 1 and the simplified block diagram of FIG. 2. The illustrated bank of capacitors 50 includes one or more high grade capacitors that are mounted on or within the module 11 (the speed controller housing) as part of the control circuitry, where it is connected across the two battery lines 31 and 32. Of course, the bank of capacitors 50 may be mounted elsewhere (e.g., directly on the battery 13 or other location on the R/C model), without departing from the scope of various ones of the claims.

The one or more high grade capacitors forming the bank of capacitors 50 are depicted in FIG. 2 by the combination of a capacitor 51 and a resistor 52, with the nickel cadmium battery 13 being depicted by a 7.2-volt voltage source 53 and a 0.050 ohm internal battery resistance 54. The capacitor 51 represents the equivalent combined capacitance of the bank of capacitors 50, and the resistor 52 represents the combined equivalent series resistance (ESR) of the bank of capacitors 50.

The illustrated bank of capacitors 50 includes twelve, parallel-connected, commercially available, high-grade capacitors, each measuring about 0.15 inch by 0.25 inch by 0.125 inch thick (e.g., the 100 microfarad, 16 Vdc, 0.15 ohm ESR capacitors available from SPRAGUE). Each of those capacitors is not individually illustrated. Instead, the capacitor 51 in FIG. 3 represents the combined 1200-microfarad total capacitance of the bank of capacitors 50, and the resistor 52 represents the combined 0.0125 ohms ESR.

With the combined ESR being less than the combined internal resistance of the battery 13 (depicted by a resistor 53 in FIG. 2), and the product of the combined total capacitance in microfarads times the switching frequency in Hertz being at least 4,000,000, the bank of capacitors 50 advantageously stores battery power during the OFF time of each cycle in order to contribute it during the ON times. As a result, a lower maximum current level is required through the internal battery resistance (resistor 54) for the same average current level to the motor 12. That means less $I^2R_i$ loss and moderation of excursions in the effective battery output voltage (across the battery lines 31 and 32).

Based upon the preceding and subsequent descriptions, one of ordinary skill in the art can substitute various other capacitors having different electrical characteristics and physical sizes to achieve the advantages described without departing from the scope of the claims. The combined total capacitance value may be different for different switching frequencies and still store sufficient energy during the OFF time, and ESR values may be different for different values of battery internal resistance. One of ordinary skill in the art may calculate the required capacitance values for sufficient energy storage using known techniques.

Thus, the invention capacitively loads the battery with a bank of one or more high grade capacitors. The bank of capacitors charges while the speed controller is in the OFF state so that it is ready to contribute current when the speed controller is in the ON state to thereby decrease $I^2R_i$ loss. It moderates current excursions in order to decrease $I^2R_i$ loss and increase effective battery output voltage while maintaining a desired average current. It results in an effective internal resistance of the battery that is less than the actual combined internal resistance of the battery. Testing indicates that batteries run significantly cooler and that as much as a 5% to 15% increase may be realized in energy delivered to the motor, with correspondingly longer run times before "running out of gas." The miniature physical size of the capacitors particularly adapts them for use as part of an R/C control system.

Although an exemplary embodiment has been shown and described, one of ordinary skill in the art may make many changes, modifications, and substitutions without necessarily departing from the spirit and scope of the invention. The invention may, for example, operate at other switching rates than 20 KHz. It may be used with converters and other circuits where battery power is periodically turned on and off other than R/C control systems.

What is claimed is:

1. A method for reducing the amount of power dissipated in the internal resistance of a nickel cadmium battery supplying current to a motor of a radio controlled model through a speed controller circuit that switches the battery on and off at a known switching rate and duty ratio to result in ON periods during which the battery is coupled to the load and OFF periods during which the battery is not coupled to the load, the method comprising:

providing a bank of capacitors connected across the battery, the bank of capacitors having at least one capacitor, a combined equivalent series resistance that is less than the internal resistance of the battery, and a combined capacitance such that the product of the combined capacitance expressed in microfarads and the switching rate expressed in Hertz is at least $4\times10^6$;

storing energy from the battery in the bank of capacitors during the OFF periods for contribution to the load during the ON periods.

2. A method for reducing the amount of power dissipated in the internal resistance of a nickel cadmium battery supplying current to a load through a circuit that switches the battery on and off at a known switching rate and duty ratio to result in ON periods during which the battery is coupled to the load and OFF periods during which the battery is not coupled to the load, the method comprising:

providing a bank of capacitors connected across the battery, the bank of capacitors having at least one capacitor, a combined equivalent series resistance that is less than the internal resistance of the battery, and a combined capacitance such that the product of the combined capacitance expressed in microfarads and the switching rate expressed in Hertz is at least $4\times10^6$;

storing energy from the battery in the bank of capacitors during the OFF periods for contribution to the load during the ON periods.

3. A method as recited in claim 2 for reducing the amount of power dissipated in the internal resistance of a nickel cadmium battery supplying current to a drive motor of a radio controlled model through the circuit with the circuit switching the battery on and off at a 16,600 Hertz switching rate and a variable duty ratio, wherein the step of providing a bank of capacitors includes providing a bank of capacitors having a combined capacitance of about 1200 microfarads and a combined equivalent series resistance of about 0.0125 ohms.

4. A control system for a radio controlled model having a battery and a motor, the control system comprising:

a speed controller having an input connected to the battery, an output connected to the motor, and means in the form of a circuit connected between the input and the output for switching current from the battery to the motor on and off at a known switching rate and duty ratio to result in ON periods during which the battery is coupled to the motor and OFF periods during which the battery is not coupled to the motor; and means for storing energy from the battery during the OFF periods for contribution to the load during the ON periods, including a bank of capacitors connected across the input, the bank of capacitors having at least one capacitor, a combined equivalent series resistance less than the internal resistance of the battery, and a combined capacitance such that the product of the combined capacitance expressed in microfarads and the switching rate expressed in Hertz is at least $4\times10^6$;.

5. A control system as recited in claim 4, wherein the bank of capacitors has a combined capacitance of about 1200 microfarads and a combined equivalent series resistance of about 0.0125 ohms.

6. A control system as recited in claim 4, wherein the switching rate is 16,600 Hertz.

7. A control system as recited in claim 4, wherein the speed controller includes a housing and the bank of capacitors are mounted on the housing.

* * * * *